US005557378A

United States Patent [19]

Abreu et al.

[11] Patent Number: 5,557,378

[45] Date of Patent: Sep. 17, 1996

[54] LIQUID IMMERSION DEVELOPMENT MACHINE HAVING A PRESSURE DIFFERENTIAL NIP APPARATUS

[75] Inventors: Christian O. Abreu, Rochester; Shyshung S. Hwang, Penfield, both of N.Y.

[73] Assignee: Xerox Corporation, Stamford, Conn.

[21] Appl. No.: 519,868

[22] Filed: Aug. 25, 1995

[51] Int. Cl.[6] ..... G03G 15/11

[52] U.S. Cl. ..... 355/256; 355/297

[58] Field of Search ..... 355/256, 296, 355/297

[56] References Cited

U.S. PATENT DOCUMENTS

| | | | |
|---|---|---|---|
| 3,741,643 | 6/1973 | Smith et al. | 355/256 |
| 4,023,899 | 5/1977 | Hayashi et al. | 355/10 |
| 4,181,094 | 1/1980 | Gardiner | 118/652 |
| 4,259,006 | 3/1981 | Phillips et al. | 355/256 |
| 4,733,273 | 3/1988 | Lloyd | 355/256 |
| 4,878,090 | 10/1989 | Lunde | 355/256 |
| 5,063,413 | 11/1991 | Domoto et al. | 355/296 |
| 5,078,088 | 1/1992 | Nishikawa | 355/256 X |
| 5,424,813 | 6/1995 | Schlueter, Jr. et al. | 355/256 |

*Primary Examiner*—Nestor R. Ramirez
*Attorney, Agent, or Firm*—Tallam I. Nguti

[57] ABSTRACT

A Liquid Immersion Development, LID, reproduction machine having a moving liquid toner image carrying surface, includes an excess carrier liquid removing apparatus. The excess carrier liquid removing apparatus includes a housing defining a chamber, and an opening through the housing into the chamber for mounting against the liquid toner image carrying surface. The excess carrier liquid removing apparatus also includes a roller mounted rotatably to the housing and within the chamber for forming an image processing nip gap, that has an image entrance side and an image exit side, with the liquid toner image carrying surface. The excess carrier liquid removing apparatus further includes an air pressure creating device associated with the chamber for creating an air pressure differential within the chamber and across the image processing nip from one to the other of the entrance and the exit sides, in order to desirably affect flow of carrier liquid through the nip with minimal carrier liquid vaporization and with no liquid toner image disturbance.

9 Claims, 3 Drawing Sheets

LIQUID IMMERSION DEVELOPMENT MACHINE HAVING A PRESSURE DIFFERENTIAL NIP APPARATUS

BACKGROUND OF THE INVENTION

This invention relates to electrostatographic reproduction machines, and more particularly to a liquid electrostatographic reproduction machine having a pressure differential nip image processing apparatus.

A typical electrostatographic reproduction machine employs a photoconductive or dielectric member that is sensitized by charging to a substantially uniform potential. The charged portion of the photoconductive member is exposed to the light image of a document. Exposure of the charged photoconductive member selectively dissipates the charge to record an electrostatic latent image. The electrostatic latent image corresponds to the informational areas of the document. As is also known, such a latent image can be formed equally using an ionographic or other equivalent process. The electrostatic latent image recorded on the photoconductive member is developed by contact with a developer material. The developer material can be a dry material comprising carrier granules having adhering toner particles. The latent image attracts the toner particles from the carrier granules to form a toner powder image on the photoconductive surface. The toner powder image is then transferred and permanently fused to a copy sheet.

An electrostatic latent image also may be developed by a liquid development system with a liquid developer material. In a liquid development system, the photoconductive surface is contacted with an insulating liquid carrier having dispersed finely divided charged marking particles. The electrical field associated with the electrostatic latent image attracts the charged marking particles to the photoconductive surface to form a visible image.

Liquid developing imaging processes utilize a liquid developer typically having about 2 percent by weight of fine solid particulate toner material dispersed in a liquid carrier. The liquid carrier is typically a hydrocarbon. In the developing process, the image is transferred to a receiver which may be an intermediate belt. The image on the photoreceptor contains about 12 weight percent of particulate toner in hydrocarbon carrier liquid. To improve the quality of transfer of a developed liquid toner image to a receiver, percent solids in liquid should be increased to about 25 percent by weight. Such an increase in percent solids may be achieved by removing excess hydrocarbon carrier liquid. However, excess hydrocarbon carrier liquid must be removed in a manner that results in minimum degradation of the toner image, as well as in minimal air pollution from evaporation of liquid carrier.

Examples of various devices for removing excess hydrocarbon carrier liquid from liquid toner developed images are disclosed in the following references.

U.S. Pat. No. 4,023,899 issued May 17, 1977, to Hayoski et al. discloses a controlled-gap and controlled-velocity hard roller for effecting removal of such liquid.

U.S. Pat. No. 4,181,094 issued Jan. 1, 1980, to Gardiner discloses a mechanical barrier including an air pressure slot. The barrier is positioned spaced from the image surface, a gap closer than the thickness of liquid developer. Compressed air is introduced into the barrier and focused directly onto the image-surface through the slot.

U.S. Pat. No. 4,259,006 issued Mar. 31, 1981, to Phillips et al. discloses an air knife devices for focusing a jet of air at about an angle of 45 directly onto the image surface.

U.S. Pat. No. 5,063,413 issued Nov. 5, 1991, to Domoto et al. discloses apparatus for focusing air flow directly along the image surface in a direction parallel and opposite to the direction of movement of the image surface.

There are disadvantages associated with these types of excess carrier liquid removing devices. The roller type devices tend to damage the toner image on the image surface or photoreceptor particularly where the roller is brought into pressing engagement with the surface of the photoreceptor or image surface. Usually, difficulty is also experienced in obtaining a roller that has a sufficiently smooth and planar peripheral surface so as to maintain good adherence of toner images on the photoreceptor, as well as, in synchronizing the rotation of the roller with movement of the photoreceptor. In the air knife type, the moving air directly contacts and vaporizes carrier liquid. The air then tends to become polluted by such vaporization of the carrier liquid. Additionally, the image on the photoreceptor usually is undesirably splashed with the blown carrier liquid. Also, noise is caused by the moving air stream, and the toner on the photoreceptor is blown by the air causing distortion of the image. It is generally also difficult to apply a uniform moving air stream to the photoreceptor.

SUMMARY OF THE INVENTION

In accordance with one aspect of the present invention, there is provided a LID (Liquid Immersion Development) reproduction machine having a moving liquid toner image carrying surface including an excess carrier liquid removing apparatus. The excess carrier liquid removing apparatus has a housing defining a chamber, and an opening through the housing into the chamber for mounting against the liquid toner image carrying surface. The excess carrier liquid removing apparatus also includes a roller mounted rotatably to the housing and within the chamber for forming, with the liquid toner image carrying surface, an image processing nip having an image entrance side and an image exit side. The excess carrier liquid removing apparatus further includes an air pressure creating device associated with the housing for creating an air pressure differential within the chamber and across the image processing nip, from one to the other of the entrance and the exit sides, thus desirably affecting flow of carrier liquid with minimal carrier liquid vaporization and with no liquid toner image disturbance, through the nip.

Pursuant to another aspect of the present invention, there is provided a method in a LID reproduction machine of removing excess carrier liquid from a liquid toner image on a moving liquid toner image carrying surface. The method includes the steps of rotatably mounting a roller within a chamber defined by a housing having an opening, and of forming an image processing nip between the roller and the liquid toner image carrying surface by mounting the housing with the opening against the image carrying surface. The method also includes the step of rotating the roller against the liquid toner image to cause excess carrier liquid in the liquid toner image to move through the nip bridging the roller to the liquid toner image, thereby dividing the chamber into a first air pocket on an exit side and a second air pocket on an entrance side of the image processing nip. Importantly, the method includes the step of creating positive air pressure in the first air pocket on the exit side of the nip, and negative air pressure on the entrance side of the nip for desirably affecting the flow of carrier liquid without carrier liquid evaporation and without liquid toner image disturbance, through the nip.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
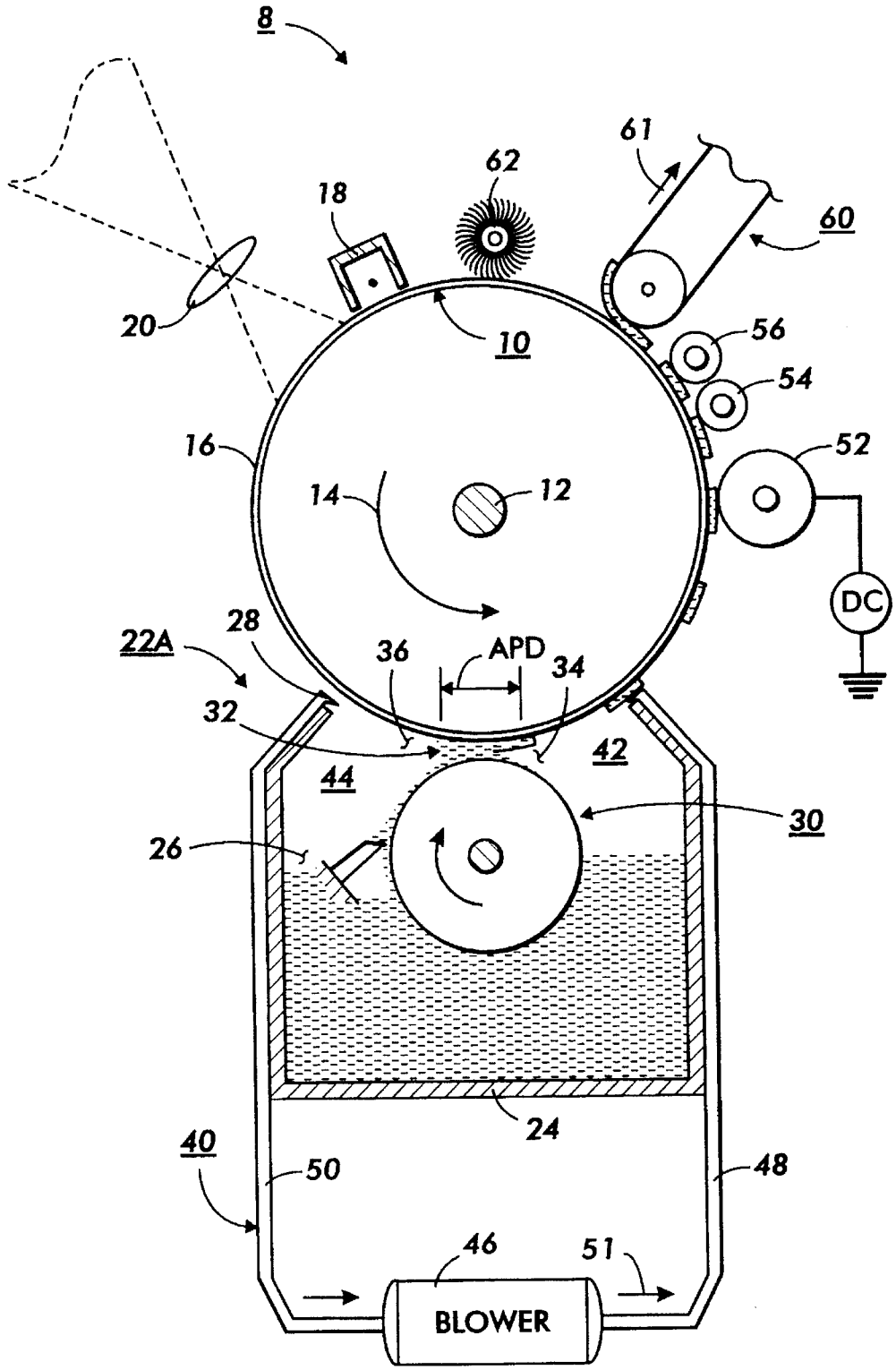
FIG. 1 is a schematic illustration of a liquid electrophotographic (LID) reproduction machine including one embodiment of an excess carrier liquid removing apparatus having a development roller forming a pressure differential nip according to the present invention.

Referring first to FIG. 1, an exemplary electrophotographic liquid ink development reproduction machine is illustrated and includes a photoconductive drum 10. The drum 10 is rotatable about an axle 12 in the direction of arrow 14. Drum 10 includes a photoconductive liquid toner image carrying surface 16 on which a uniform layer of charge, for example, positive charge, is applied by a corona device 18. As is well known, the charged surface 16 is imagewise exposed by exposure means including, for example, a lens 20 to form a latent image on the surface 16.

Continued rotation of the drum 10 brings the latent image on the surface 16 into a development and carrier liquid removing relationship with a first embodiment excess carrier liquid removing apparatus 22A of the present invention. The excess carrier liquid removing apparatus 22A comprises a development housing 24 defining a chamber 26. The chamber 26 is suitable for containing air, and liquid developer including charged toner and carrier liquid. The housing 24 includes an opening 28 through the housing into the chamber for mounting against the liquid toner image carrying surface 16. The apparatus 22A also includes a development roller 30 that is mounted rotatably to the housing 24 and partially within the chamber 26 for forming an image processing nip 32 with, and spaced a development gap from, the liquid toner image carrying surface 16. Liquid toner and carrier liquid are moved by the roller 30 through the nip 32 into contact with the image carrying surface 16 for image development. As formed, the image processing nip 32 has an image exit side 34, and an image entrance side 36, relative to image movement with the surface 16.

Importantly in accordance with the present invention, the apparatus 22A further includes air pressure creating device 40 associated with the housing 24 for creating an air pressure differential APD within the chamber 26, and across the image processing nip 32 from one to the other of the entrance and the exit sides of the nip. As such, desirable flow of carrier liquid, without unwanted carrier liquid vaporization and without liquid toner image disturbance, is achieved through the nip 32.

Liquid developer including toner and carrier liquid which are being moved by the development roller 30 through the development nip 32 acts to bridge the development gap between the roller 30 and the surface 16, thereby separating the air containing portion of the chamber 26 into a first air pocket 42 and a second air pocket 44 located between liquid developer in the chamber 26 and the image carrying surface 16. The first and the second pockets 42, 44 respectively are located as such to the exit side 34, and the entrance side 36 respectively of the development nip. The air pressure creating device 40 is arranged relative to the chamber 26 so that it creates positive air pressure in the first air pocket 42 and negative air pressure in the second air pocket 44.

As shown, the air pressure creating device 40 includes an air moving apparatus such as a blower 46 that is connected to a first conduit or plenum 48 for moving air gently under pressure into the first air pocket 42 on the exit side 34 of nip 32 to create a positive air pressure in such pocket 42. Preferably and advantageously, such a positive air pressure can be created without blowing or focusing the moving air directly onto a liquid toner image on the surface 16. Undesirable evaporation of carrier liquid, and undesirable image disturbance are therefore avoided. The air moving apparatus 46, as shown, is also connected to a second plenum 50 for moving air gently under pressure out of the second air pocket 44 on the entrance side 36 of nip 32. Air flow through the blower 46 and plenums 48 and 50 is therefore in the direction of the arrow 51.

The net result is a desirable air pressure differential APD across the nip 32 which advantageously retards the flow of relatively lower viscosity carrier fluid through the development gap, while not affecting the transfer of charged toner particles being attracted across the nip by a charge latent image on the surface 16. Less carrier liquid flowing through the nip as such of course is desirable, and means a conditioning developed liquid toner image with an already relatively higher percent solids at that point in the liquid electrophotographic process, as compared to conventionally developed liquid toner images.

Following such conditioning development, a rotating metering roller 52 of any suitable construction operates to further meter and additionally remove excess carrier liquid from the developed liquid toner image now on surface 16. Next, a rigidizing roller 54 is used to compress and rigidize the now relatively high percent solids toner image on surface 16, and a squeegee roller 56 is used to further remove any more excess carrier liquid from such image prior to its transfer from the surface 16.

For such transfer, an intermediate transfer member 60 is provided for first receiving the rigidized liquid toner image from the surface 16. Subsequently, the image is transferred from member 60 to a receiving image substrate (not shown) such as to a copy sheet of paper. Following transfer of the image from surface 16, surface 16 is subsequently cleaned by a cleaning device such as by a roller 62, so as to prepare the surface for use again in forming another image.

Figure 2:
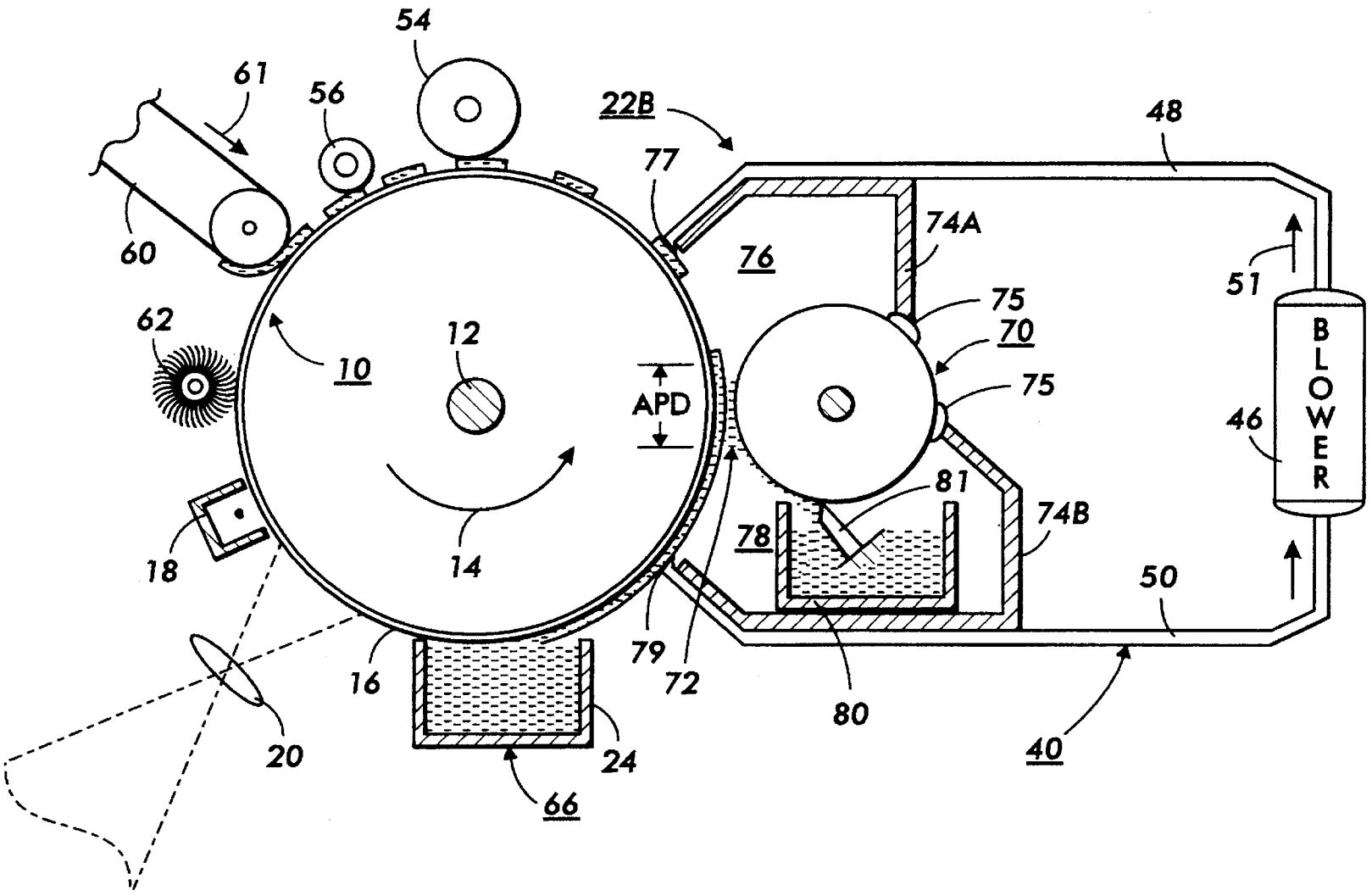
FIG. 2 is a schematic illustration of a liquid electrophotographic (LID) reproduction machine including another embodiment of an excess carrier liquid removing apparatus having a metering roller forming a pressure differential metering nip according to the present invention.

Referring now to FIG. 2, an exemplary electrophotographic liquid ink development or liquid immersion development (LID) reproduction machine is illustrated and includes a second embodiment excess carrier liquid removing apparatus 22B of the present invention. The reproduction machine as above includes a photoconductive drum 10 that is rotatable about an axle 12 in the direction of arrow 14. As is well known, the drum 10 can of course be replaced with a belt that is properly supported under tension using backer rollers or bars. The belt, and drum 10 as shown, includes a photoconductive liquid toner image carrying surface 16 on which a uniform layer of charge, for example, positive charge, is applied by a corona device 18. As is well known, the charged surface 16 is imagewise exposed by exposure means including, for example, a lens 20 to form a latent image on the surface 16.

Continued rotation of the drum 10 brings the latent image on the surface 16 into a development relationship with a conventional development apparatus 66 that includes a housing such as 24 for containing liquid developer material. As shown, the housing 24 may be adapted so that the drum 10 rotates into contact with liquid developer contained inside the housing, or as is well known, an application device can be employed to move developer material from within the housing 24 for application to latent images on the surface 16.

Following such conventional development, the drum 10 rotates the developed image on the surface 16 into an image conditioning relationship with the second embodiment excess carrier liquid removing apparatus 22B of the present invention. The second embodiment excess carrier liquid removing apparatus 22B includes a metering roller 70 that is mounted rotatably spaced from, and for forming an image processing nip 72 with, the liquid toner image carrying surface 16. The metering roller is spaced so as to contact and meter or remove excess carrier liquid from the liquid developer material forming the liquid toner images on the surface 16. As such, the carrier liquid being removed from the surface 16 bridges the spacing gap between the roller 70 and the surface 16.

The apparatus 22B, as shown, includes a first housing 74A mounted on the exit side of the nip 72, relative to the direction of movement of the surface 16. The housing 74A is sealed by suitable sealing means 75 against the metering roller 70 so as to define a first air chamber 76. The chamber 76 is suitable for containing air except at a first controlled gap 77 through which conditioned images on the surface 16 are moved. The apparatus 22B also includes a second housing 74B mounted on the entrance side of the nip 72, relative to the direction of movement of the surface 16. The housing 74B is also sealed by suitable sealing means 75 against the metering roller 70 so as to define a second air chamber 78 on the entrance side of nip 72. The chamber 78 is also suitable for containing air except at a second controlled gap 79 through which developed images on the surface 16 are moved into the apparatus 22B. As shown, the second air chamber 78 also includes a collection trough 80 for receiving and containing excess carrier liquid removed from the roller 70 by a cleaning blade 81.

Importantly in accordance with the present invention, the apparatus 22B further includes an air pressure creating device 40 associated with the first and the second housings 74A, 74B respectively for creating an air pressure differential APD across the image processing nip 72 from one to the other of the entrance and the exit sides thereof. The air pressure creating device 40 is arranged relative to the first and the second air chambers 76 and 78 so as to create positive air pressure in the first air chamber 76, and negative air pressure in the second air chamber 78. As such, desirable flow of excess carrier liquid, without carrier liquid vaporization and without liquid toner image disturbance, is achieved through the nip 72.

As further shown, the air pressure creating device 40 also includes an air moving apparatus such as a blower 46 connected to a first conduit or plenum 48 for moving air gently under pressure into the first chamber 76 on the exit side of nip 72 to create the positive air pressure therein. Preferably and advantageously, such a positive air pressure is created without blowing or focusing moving air directly onto a liquid toner image on the surface 16. Consequently, undesirable evaporation of carrier liquid, and undesirable image disturbance are therefore avoided.

The air moving apparatus 46, as shown, is also connected to a second plenum 50 for moving air gently under pressure out of the second air chamber 78 on the entrance side of nip 72. The net result is a desirable air pressure differential APD across the nip 72 which advantageously retards the flow of relatively lower viscosity carrier fluid through the metering gap of nip 72, while at the same time not affecting the transfer of charged toner particles for forming the image on the surface 16. Significantly and relatively less carrier liquid thus flows through the nip 72, which of course is desirable. The conditioned liquid toner image thus has a relatively higher percent solids at this stage of a liquid electrostatographic process, as compared to conventionally developed liquid toner images.

Following such conditioning development, a rigidizing roller 54 is used to compress and rigidize the now relatively high percent solids toner image on surface 16, and a squeegee roller 56 is used to further remove any more excess carrier liquid from such image prior to its transfer from the surface 16.

For such transfer, an intermediate transfer member 60 moving in the direction of arrow 61 is provided for first receiving the rigidized liquid toner image from the surface 16. Subsequently, the image is transferred from member 60 to a receiving image substrate (not shown) such as a copy sheet of paper. Following transfer of the image from surface 16, surface 16 is subsequently cleaned by a cleaning device such as by a roller 62, so as to prepare the surface for use again in forming another image.

Figure 3:
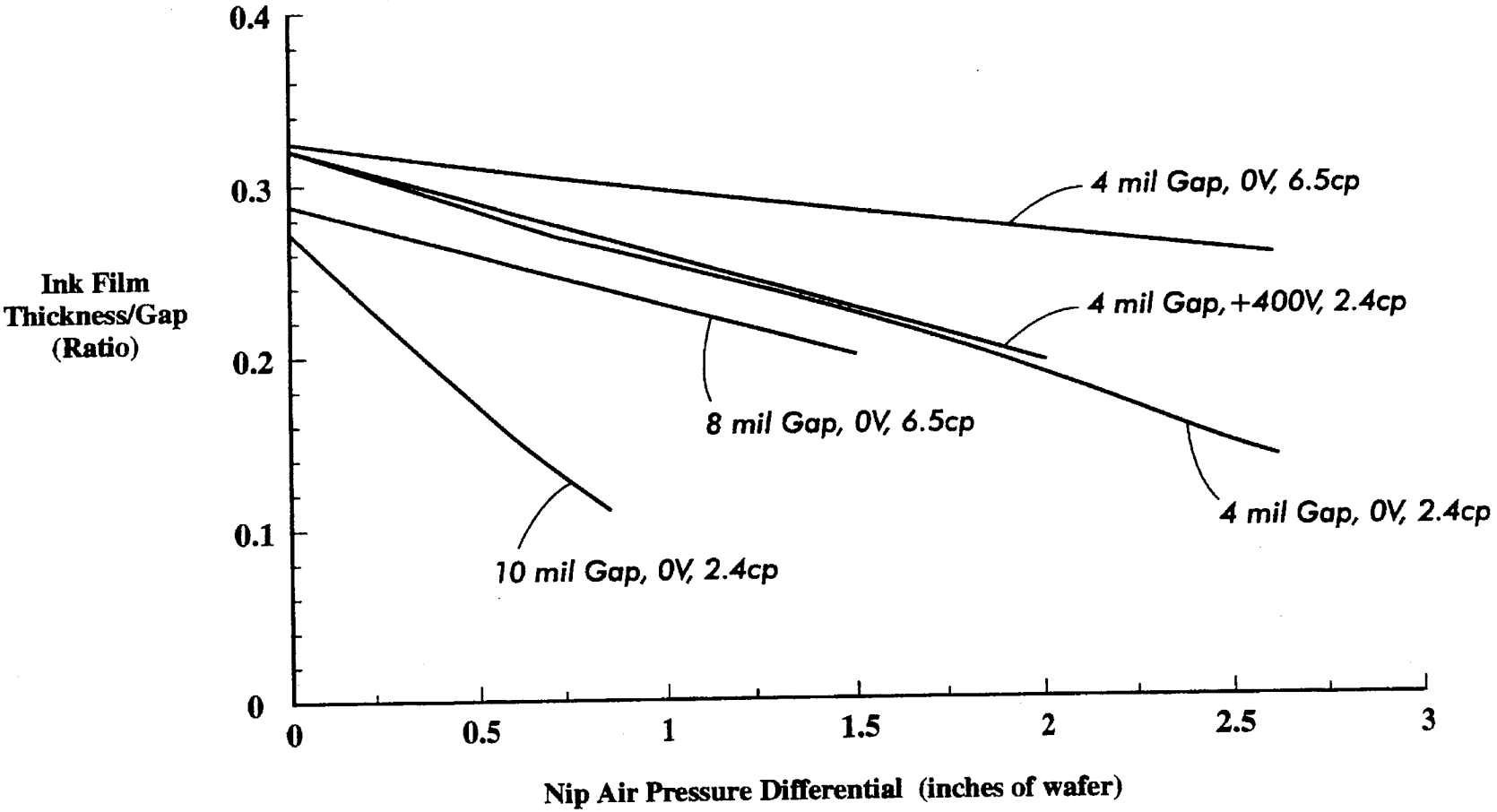
FIG. 3 is an illustrative plot of air pressure differential across the metering nip of FIG. 2 versus carrier liquid layer thinning measurements according to the present invention.

The process of thinning the ink or liquid developer film on a developing or developed image on an image carrying surface with an air pressure differential (APD) according to the present invention, was demonstrated in a test fixture. An air pressure box was made and mounted at the photoconductive drum exit side for testing. The box was connected to a blower so that a pressure differential is created from the exit to the entrance of the nip between the photoreceptor and a reverse metering roller. Referring now to FIG. 3, in which ink film thickness as a ratio to gap size is plotted for various inks and various gap sizes. As shown, it was found that as the air pressure differential is increased, the film thickness to gap ratio, or specifically the ink film thickness or thickness of carrier liquid is reduced. The results of ink film or carrier liquid layer thickness to gap size ratio, illustrated in FIG. 3 as a function of applied air pressure differential, were obtained based on mass measurements. For the test, the photoconductive drum was rotating at 17 inches per second, and the reverse metering roller at 14 inches per second.

An experimental cyan ink with 2% solids and having ISOPAR L (trademark of Exxon Corp.) as the carrier liquid at a viscosity of 2.4 cp, was first used at a metering nip gap of 4 mils. Without an air pressure differential (APD) across the nip, the ratio of the thickness of the ink film or carrier liquid layer to the gap size, as measured on the exit side of the nip, was about 0.32. However, as the pressure differential was increased to 2.6" of water, that ratio was reduced from 0.32 to 0.19—a reduction of 56% in ink film thickness. There was not much difference between results at 400 V bias and at no bias on the metering roll. When the metering nip gap was increased to 10 mils, the ratio of the ink film thickness to the gap size was 0.27 without an air pressure differential, and 0.11 with an air pressure differential (APD) of 0.85" of water, for a reduction of about 60%.

Accordingly, it can be seen that the ink film or carrier liquid layer thickness can be reduced further with a higher and higher air pressure differential across the nip. Unfortunately however, it has been found that when the air pressure differential is greater than some critical value for a particular ink, an undesirable nonuniform ink film or carrier liquid layer will result.

A more viscous ink at 6.5 cp, was also tested using a metering gap of 8 mils. Without an air pressure differential, the ratio of the ink film or carrier liquid layer thickness to the size of the gap was 0.29, and at an air pressure differential of 1.5" of water, it was 0.2—a reduction of about 31% in ink film thickness.

The advantages of the embodiments of excess carrier liquid removing or ink film thinning apparatus of the present invention include relieve image conditioning, relatively easy recovery of carrier liquid, and relatively more relaxed manufacturing tolerances for the rolls and image processing nip gaps. With conventional LID development/metering systems, very small gaps (of 50 to 75 microns) are required for effective image development or excess carrier liquid metering. In addition, the size of development or metering rollers ordinarily needs to be relatively large (in the order of several inches in diameter). However, with the excess carrier liquid removing or ink film thinning apparatus of the present invention, the size of such rollers can be decreased, and that of the nip gaps can be increased relative to conventional system values for the same. This is because according to the present invention, an air pressure differential applied across the development and/or metering nip, at the roller Photoconductive surface interface, operates to effectively increase carrier liquid shear rate, and hence tends to allow for the use of relatively larger gaps and/or smaller diameter rollers.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An excess carrier liquid removing apparatus for use in a LID reproduction machine having a moving liquid toner image carrying surface, the excess carrier liquid removing apparatus comprising:

(a) a housing defining a chamber suitable for containing air, and containing liquid developer including liquid toner and carrier liquid, said chamber including a first air pocket and a second air pocket between the liquid toner and the image carrying surface;

(b) an opening through said housing into said chamber for mounting against the liquid toner image carrying surface;

(c) a roller mounted rotatably to said housing and within said chamber for forming a liquid toner image processing nip with the liquid toner image carrying surface, said image processing nip having an image entrance side and an image exit side, said first and said second air pockets being located to said exit side and said entrance side respectively of said image processing nip; and (d) air pressure creating means associated with said housing for creating an air pressure differential within said chamber across said image processing nip from one to the other of said entrance and said exit sides of said nip for affecting flow of carrier liquid without carrier liquid vaporization and without liquid toner image disturbance, through said nip, said air pressure creating means moving air out of said second air pocket on said entrance side of said image processing nip, and moving air gently into said first air pocket on said exit side of said image processing nip so as to avoid undesirable evaporation of carrier liquid.

2. The excess carrier liquid removing apparatus of claim 1, wherein said chamber is suitable for containing air, and containing liquid developer including liquid toner and carrier liquid, said roller is a development roller, and said image processing nip is a development nip through which liquid toner and carrier liquid are moved into contact with the image carrying surface for image development.

3. The excess carrier liquid removing apparatus of claim 1, wherein said chamber is suitable for containing air and excess carrier liquid, said roller is an excess carrier liquid metering roll, and said image processing nip is an excess carrier liquid metering nip through which said metering roll is rotated for removing excess carrier liquid from the liquid toner developed image on said image carrying surface.

4. A method in a LID reproduction machine of removing excess carrier liquid from a liquid toner image on a moving liquid toner image carrying surface, the method comprising the steps of:

(a) rotatably mounting a roller within a chamber defined by a housing having an opening;

(b) forming an image processing nip including a gap between the roller and the liquid toner image carrying surface by mounting the housing with the opening against the image carrying surface;

(c) rotating the roller relative to the liquid toner image to cause excess carrier liquid in the liquid toner image to bridge the nip gap and seal the roller against the liquid toner image, thereby dividing the chamber into a first air pocket on an exit side and a second air pocket on an entrance side of the image processing nip; and (d) creating positive air pressure in the first air pocket on the exit side of the nip, and negative air pressure on the entrance side of the nip for an air pressure differential to influence the flow of carrier liquid without carrier liquid evaporation and without liquid toner image disturbance, through the nip.

5. The excess carrier liquid removing apparatus of claim 3, wherein said chamber includes a first air chamber portion and a second air chamber portion located to said exit side and said entrance side respectively of said metering nip.

6. The excess carrier liquid removing apparatus of claim 1, wherein said air pressure creating means is arranged relative to said chamber for creating positive air pressure in said first air pocket and negative air pressure in said second air pocket.

7. The excess carrier liquid removing apparatus of claim 1 wherein liquid developer including carrier liquid being moved through said development nip seals said development roller against said image carrying surface and separates said first and said second air pockets one from the other.

8. The excess carrier liquid removing apparatus of claim 5, wherein said air pressure creating means is arranged relative to said chamber for creating positive air pressure in said first air chamber portion and negative air pressure in said second air chamber portion.

9. The excess carrier liquid removing apparatus of claim 5, wherein excess carrier liquid being removed from the liquid toner image within said metering nip seals said metering roll against said image carrying surface and separates said first air chamber portion from said second air chamber portion.

* * * * *